United States Patent [19]

Caule

[11] 4,312,922

[45] Jan. 26, 1982

[54] LUBRICATED CUPREOUS SHEET COMPRISING AN ORGANOPHOSPHONATE LAYER AND PROCESS THEREFOR

[75] Inventor: Elmer J. Caule, New Haven, Conn.

[73] Assignee: Olin Corporation, New Haven, Conn.

[21] Appl. No.: 111,206

[22] Filed: Jan. 11, 1980

[51] Int. Cl.[3] ..... B05D 5/08; B32B 15/18; C23F 7/00

[52] U.S. Cl. ..... 428/446; 148/6.15 R; 148/6.16; 252/389 A; 427/327; 427/407.1; 427/409; 427/417; 428/457; 428/470; 428/497

[58] Field of Search ..... 428/497, 457, 470, 446, 428/471; 148/6.15 R, 6.16; 427/327, 407 R, 409, 417, 407.1; 252/389 A

[56] References Cited

U.S. PATENT DOCUMENTS

| | | | |
|---|---|---|---|
| 3,293,088 | 12/1966 | Hofheim | 148/6.15 R |
| 3,431,217 | 3/1969 | Hwa | 252/389 A |
| 3,630,796 | 12/1971 | Schmidt | 148/6.15 R |
| 3,634,146 | 1/1972 | Wystrach | 148/6.15 R |
| 3,899,364 | 8/1975 | Evans et al. | 148/6.15 R |

*Primary Examiner*—James C. Cannon
*Attorney, Agent, or Firm*—Paul Weinstein

[57] ABSTRACT

Copper or copper alloy sheet or foil displaying improved forming and working properties is prepared by the provision over its surface of a thin coating containing a copper salt of an organophosphonic acid, and subsequently, an outer film of lubricant strongly retained by the coating is applied. To form the coating, the sheet or foil is immersed for a short time in an aqueous solution containing a phosphonic acid, rinsed and dried, the treatment being combined with or preceded by oxidation of the sheet surface, and the lubricant film is applied prior to forming operations, preferably as the final step in the production of the cupreous sheet.

4 Claims, No Drawings

LUBRICATED CUPREOUS SHEET COMPRISING AN ORGANOPHOSPHONATE LAYER AND PROCESS THEREFOR

BACKGROUND OF THE INVENTION

The present invention relates to lubricated copper or copper alloy sheet, strip, or foil of significantly improved working and forming properties, imparted by a novel lubricant-retentive, invisible surface coating, and to the method of manufacture thereof.

The mass production of small parts and articles of copper and copper alloys by individual or successive working and/or forming operations has long been known to require, among other items, the selection of the proper lubricant in order to prolong tool life and also to attain the desired unmarred surface appearance of the finished article. However, specialized lubricant compositions have at times been required in order to facilitate the working and forming operations, by effecting a sizeable reduction in friction. Quite often, these compositions must be removed from the work piece promptly after the operation, in order to avoid undesired tarnishing or harmful corrosion effects.

Thus, need has arisen for simplification of the manufacturing procedures by elimination of the need for specialized lubricant compositions and the requirement for prompt and frequent cleaning operations.

Some process steps in accordance with this invention may be carried out generally as described in U.S. Pat. No. 3,837,929 issued Sept. 24, 1974 and in related patents such as U.S. Pat. No. 3,677,828 issued July 18, 1972. Reference is likewise made to U.S. Pat. No. 3,224,908 issued Dec. 21, 1965 to Duch et al., as being the closest known prior art approach, though quite distant, in disclosing the coating of steel, to prevent corrosion and to provide good adherence of lacquers and varnishes, by treatment with a solution containing an alkene phosphonic acid, such as vinyl phosphonic acid, together with any of several varieties of polymers and copolymers.

It is therefore a principal object of this invention to provide a cupreous sheet, which term is intended to embrace sheet, strip, foil, or other article made of copper or of copper alloys, having a surface coating capable of strongly retaining, as by adsorption, a lubricant film which facilitates subsequent working or forming operations.

It is a further object to provide such coated cupreous sheet having an outer lubricant film retained thereon which in working or forming operations can effect a substantially greater reduction in frictional forces, and thus accomplish a far greater increase in lubricity, than the identical lubricant when applied directly to the uncoated cupreous sheet.

A further object is to provide a process which will efficiently and inexpensively provide a cupreous sheet with such a first surface coating and an outer lubricant film thereover.

Other objects and advantages of this invention will become apparent hereinafter.

SUMMARY OF THE INVENTION

In accordance with the present invention, the foregoing objects and advantages are achieved by applying to a cupreous sheet a solution of an organophosphonic acid, or salt thereof, for 4 to 20 or more seconds at room temperature up to about 100° C., draining off excess solution, rinsing, and drying, the treatment being combined with or preceded by oxidation of the sheet surface. The coated sheet is then placed in readiness for a subsequent working or forming operation by applying a lubricant film over its surface, as by immersion or by spraying, and removing any excess by wiping or draining. The application of the lubricant film may be made prior to the forming or working operation or at a convenient time before then, preferably as the final step in the manufacture of the sheet, which may then be coiled for storage and then shipment to the fabricating plant.

The phosphonic acid, structurally an organic substitution product of phosphoric acid, is preferably one in which one of the three hydroxyl groups of phosphoric acid has been replaced by a monovalent hydrocarbon radical, which may be substituted or unsubstituted and which may be saturated or unsaturated, as by including ethylenic or carbonyl bonds. Generally, such organophosphonic acids or salts thereof are characterized as having a hydroxyl group of phosphoric acid replaced by a hydrocarbon radical, a carbon atom of which is linked directly to the phosphorus atom of the acid. Such radicals may include additional substituents which may display C to N or C to O linkages.

Thus, the organo substituent of the phosphonic acid may consist of any alkyl group such as methyl, ethyl, propyl, or higher alkyl; an aryl group such as phenyl, naphthyl, or higher aryl; an alkaryl group such as benzyl, phenyl ethyl, or higher; an alkene group such as vinyl, propene, butene, or higher group; an acyl group such as acetyl, propionyl, butyryl, or higher; an alkoxy group such as oxymethyl, oxyethyl or higher; a keto-group such as acetonyl, methyl acetonyl or higher; or a member of any of the above groups which may also include a hydroxyl, amino, or carboxyl substituent. Likewise, mixtures of two or more of the above categories of phosphonic acid are effective to produce the desired coated cupreous sheet.

The treatment may be effected with an aqueous solution containing a low to moderate concentration of the phosphonic acid component or components, preferably ranging from about 0.1 to about 30 volume percent for liquid acids or corresponding weight percent limits for solid phosphonic acids, preferably in the range of about 0.1 to 40 percent by weight.

The treating solution also preferably includes a low to moderate concentration, such as about 0.1 to about 15.0 percent by weight, preferably 0.2 to 5.0 percent by weight of oxidizing agent, such as sodium or other alkali chromate or dichromate, or nitric acid (100 percent) at a concentration of about 0.05 to about 10.0 volume percent, preferably about 0.05 to about 2.0 percent by volume $HNO_3$. Other known oxidizing agents of similar activity may be used at a comparable dilute or moderate concentration effective for the purpose, but generally with avoidance of such vigorous oxidizing conditions as might cause substantial decomposition of the phosphonic acid.

Furthermore, it may at times be convenient to apply an oxidation step separately, prior to the treatment with the phosphonic acid component or components. Such procedure may be advisable, for example, in instances where the treating solution shows signs of some instability, as by change in color, when stored in solution in the presence of oxidizing agent.

DETAILED DESCRIPTION OF THE INVENTION

The present invention may be applied with the use of the above reagents and treatments, with the inclusion, if desired, of some procedural steps as described in U.S. Pat. No. 3,837,929 issued Sept. 24, 1974. For example, the copper or copper alloy sheet or foil may be surface roughened prior to the formation of the improved surface coating.

The following illustrative examples in accordance with the invention provide specific details of procedure furnishing the desired advantageous results.

The copper or copper alloy strips treated in the following examples were selected from the following known compositions:

| C.D.A. Alloy No. | Composition |
|---|---|
| 110 | 99.90 percent Cu (min.), 0.04 percent O. |
| 194 | 2.1-2.6 Fe, 0.05-0.2 Zn, 0,01-0.04 P, balance Cu. |
| 195 | 1.3-1.7 Fe, 0.6-1.0 Co, 0.4-0.7 Sn, 0.08-0.12 P, balance Cu. |
| 260 | 68.5-71.5 Cu, balance Zn. |

The strips had a thickness of 0.25 to 6.0 mils (thousandths of an inch), a width of 0.5 tl 0.75 inch and length of 1.5 to 2.0 inches, and were in the annealed condition. The strips were cleaned and degreased by swabbing with reagent grade benzene or chlorinated hydrocarbon, before treatment in the following examples, which involved the use of the phosphonic acids, or salts thereof, listed below.

| No. | Organophosphonic Acid | Structure |
|---|---|---|
| 1 | Methylphosphonic Acid | 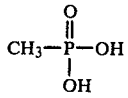 |
| 2 | Ethylphosphonic Acid | 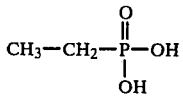 |
| 3 | Acetylphosphonic Acid | 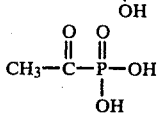 |
| 4 | Propionylphosphonic Acid | 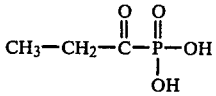 |
| 5 | Hydroxyethylidene diphosphonic Acid ("DEQUEST" 2010)* | 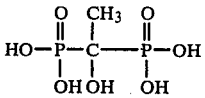 |
| 6 | Ethylenediamine-tetra (methylenephosphonic Acid) ("DEQUEST" 2041)* | 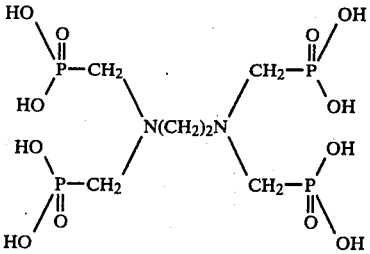 |
| 7 | Hexamethylenediamine-tetra (methylenephosphonic Acid) ("DEQUEST" 2051)* | 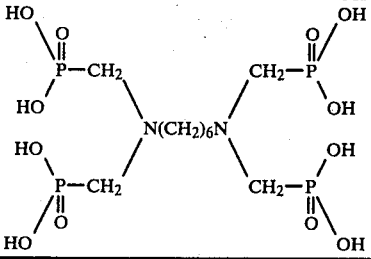 |

*Product of Monsanto Chemical Corp.

It will be noted that in the above phosphonic acids, one of the three hydroxyl groups in phosphonic acid has been replaced by an organic radical having a carbon atom linked directly to at least one phosphorus atom. Further, some of the above acids display a linkage of carbon to nitrogen or a linkage of carbon to oxygen in the organo radical. The reagents may be added in the form of salts, such as the alkali metal or ammonium salt, to the treating solution, which is maintained acidic, so that the treatment of the metal surface is effected with the corresponding phosphonic acids.

Reagents and conditions for the specific examples are listed in the following Table I.

TABLE I

| Example | Phosphonic Acid | Concn. | C.D.A. Alloy | Oxidizer | Conc. | Temp. (°C.) | Time (Secs.) |
|---|---|---|---|---|---|---|---|
| | Specific Examples | | | | | | |
| 1 | No. 1 | 18% (wt.) | 110 | A* | 3% (wt.) | 25° | 15 |
| 2 | 2 | 18% (wt.) | 110 | A | 3% (wt.) | 25° | 15 |
| 3 | 3 | 18% (wt.) | 110 | A | 3% (wt.) | 25° | 15 |
| 4 | 4 | 18% (wt.) | 110 | A | 3% (wt.) | 60° | 10 |
| 5 | 1 | 1% (wt.) | 110 | B** | 0.1% (vol.) | 60° | 15 |
| 6 | 5 | 10% (vol.) | 110 | A | 3% (wt.) | 25° | 20 |
| 7 | 5 | 10% (vol.) | 110 | A | 0.3% (wt.) | 25° | 15 |
| 8 | 7 | 5% (wt.) | 110 | A | 0.3% (wt.) | 25° | 15 |
| 9 | 6 | 5% (wt.) | 110 | A | 0.3% (wt.) | 25° | 15 |
| 10 | 5 | 1% (vol.) | 110 | B | 0.1% (vol.) | 100° | 15 |
| 11 | 5 | 1% (vol.) | 194 | B | 0.1% (vol.) | 100° | 15 |
| 12 | 5 | 1% (vol.) | 195 | B | 0.1% (vol.) | 100° | 15 |
| 13 | 5 | 1% (vol.) | 260 | B | 0.1% (vol.) | 100° | 15 |
| 14 | 6 | 1% (wt.) | 110 | B | 0.5% (vol.) | 100° | 15 |
| 15 | 6 | 1% (wt.) | 194 | B | 0.5% (vol.) | 100° | 15 |
| 16 | 6 | 1% (wt.) | 195 | B | 0.5% (vol.) | 100° | 15 |
| 17 | 7 | 1% (vol.) | 110 | B | 3% (vol.) | 100° | 15 |
| 18 | 7 | 1% (vol.) | 110 | B | 1% (vol.) | 100° | 15 |

*A = $Na_2Cr_2O_7$
**B = $HNO_3$

The treatments in the above specific examples were carried out by preparing aqueous solutions of the indicated compositions and maintaining at the stated temperature, and immersing clean strips of copper or copper alloy for the stated time period. After immersion, each strip was rinsed in cold water and dried.

An outer lubricant film was then applied to the above phosphonate-coated sheets by immersion in or spraying with the lubricant at room temperature or at a higher temperature, up to about 100° C., and removing excess lubricant by draining or wiping.

The phosphonate-coated sheets resulting from the above specific examples were closely similar in appearance to the initial samples before treatment. However, the presence of a substantially pore-free coating, transparent and invisible to the naked eye, was established by improvments effected thereby in a number of properties, even after prolonged storage in laboratory cabinets. In particular, the treated samples remained untarnished after being subjected in tests to hydrogen sulfide vapor or to laboratory atmospheres containing other pollutants.

The attainment of these and similar advantages appears to be based, at least in part, on the formation over the sheet surface of a substantially pore-free glassy coating which is amorphous, invisible and transparent. The coating is believed to contain a phosphonate compound or salt of copper, and is indicated to be at least in part of polymeric nature, the polymeric chains including multiple units of phosphorous atoms linked through intervening oxygen atoms.

Investigations of the effects of the above coating on frictional properties of sheet treated in accordance with the above specific examples showed that no appreciable change in frictional properties was accomplished, being of the order of a few percent increase or decrease at the most. However, it was found that an astonishingly large decrease in frictional properties, of the order of about 40% or more, was obtained by the application of lubricant to the coated sheets of the examples. Such decrease was significantly greater than resulted from the application of the same lubricant to the initial uncoated sheets. Furthermore, cupreous sheets having a phosphonate coating and a lubricant film applied thereover display the decreased friction, and likewise greatly increased lubricity, even after prolonged storage prior to working and/or forming operations.

The outer lubricant film may be applied to the cupreous sheet, coated as in the above specific examples, by any convenient spraying, swabbing, immersion, or similar process, followed by the removal of excess lubricant by draining or wiping. The lubricant may consist of an animal, mineral, vegetable, or synthetic oil or grease, such as lard oil, petroleum hydrocarbon oil, castor oil, or a silicone oil or grease.

The significantly increased lubricity accomplished in accordance with this invention was established by representative quantitative measurements of frictional properties. The following Table II lists such frictional force determinations carried out on initial C.D.A. alloy 110 sheet, before and after application to the sheet of the phosphonate coating according to specific example 18, and on said phosponate-coated sheet following the application of an outer film (A) of a commercial lard oil lubricant and (B) of a commercial silicone. The frictional force values were the readings observed on a pressure dial, using apparatus, as described below, in which a probe made of the CDA 110 alloy was pressed by the indicated weight of load against the surface under study.

TABLE II

Frictional Force Measurements

A. Lard Oil Lubricant

| Load (grams) | Frictional Force Readings (grams): Uncoated | Phosphonate Coated | Lard Oil Coated | Phosphonate Coated + Lard Oil |
|---|---|---|---|---|
| 5 | 1.05 | 1.2 | <1 | 0 |
| 10 | 2.05 | 2.2 | 2.1 | 1.2 |
| 15 | 3.0 | 3.4 | 2.2 | 1.2 |
| 20 | 3.8 | 4.0 | 2.3 | 2.2 |
| 30 | 6.3 | 5.9 | 5.2 | 2.4 |
| 40 | 7.7 | 9.0 | 5.4 | 3.0 |
| 50 | 11.0 | 9.5 | 9.3 | 2.6 |
| 70 | 13.0 | 14.0 | 12.5 | 5.8 |
| 100 | 21.0 | 19.0 | 14.0 | 6.7 |

B. Silicone Oil Lubricant

| Load(grams) | Silicone Coated | Phosphonate Coated + Silicone |
|---|---|---|
| 5 | 1.0 | 0 |
| 10 | 1.3 | 0 |
| 15 | 1.6 | 0.9 |

TABLE II-continued

| Frictional Force Measurements | | |
|---|---|---|
| 20 | 1.7 | 1.1 |
| 30 | 3.5 | 1.8 |
| 40 | 5.2 | 2.0 |
| 50 | 6.3 | 2.3 |
| 70 | 9.1 | 4.6 |
| 100 | 12.0 | 8.0 |

The above measurements show that the initial coating of phosphonate has but slight effect on the frictional force readings under the various loads, the values being essentially unchanged, or slightly higher or lower than values for the uncoated sheet. Appreciable decreases were found under each of the listed loads when a film of lubricant was applied to the uncoated sheet. However, when a film of lubricant was applied to the phosphonate-coated sheet, a much greater decrease in the reading resulted at each load, such that the frictional force was decreased to a value one-half to one-third or less of the reading of the uncoated cupreous sheet.

Following the above determinations, examination of the test sheets showed significantly that individual circular tracks had been formed in each of the sheet surfaces under all loads except in the case of the two having both the phosphonate coating and the outer lubricant film in accordance with this invention. These two sheets displayed substantially unmarred surfaces at the lesser loads and shallow slightly pressed circles at the three highest loads, in sharp contrast to the continuously deeply grooved circles evident in the surface of each of the comparison sheets.

The above readings were obtained by means of an apparatus utilizing a phonograph turntable and pick-up arm, the latter being modified by the substitution for the needle of a probe, consisting of a thin copper strip provided with a hemispherical protrusion. A three inch square of the cupreous sheet under study, centrally perforated, was placed over the turntable spindle and cemented to the turntable. A pressure dial, reading in grams and having a scale divided into tenths of a gram, was anchored in such position that its shaft extended horizontally, perpendicular to the pick-up arm, and with one end contacting the free end of the pick-up arm. Readings were made of the pressure gauge indication, with the recorded weight placed on the probe, and with the turntable rotating at 33 R.P.M.

The consistently low values of frictional forces attained in lubricant-treated coated cupreous sheet in accordance with this invention renders such sheet particularly advantageous for use in the manufacture of mass-produced components required in the communications and related industries. In such articles, for example, in mass-produced connectors, wherein a plurality of projecting parts are to be inserted simultaneously into corresponding recessed receptacles, it is important to minimize the frictional forces which are encountered in uniting the parts, so that they can be readily connected or disconnected by hand.

The U.S. patents referred to above are hereby incorporated herein by reference.

This invention may be embodied in other forms and modifications without departing from its spirit or essential characteristics. The present embodiments are therefore to be considered as illustrative of the invention, the scope of which is indicated by the appended claims, changes coming within the range of equivalency being intended to be embraced therein.

What is claimed is:

1. A lubricated cupreous sheet having a surface coating of an organophosphonate compound, said organophosphonate having the structure

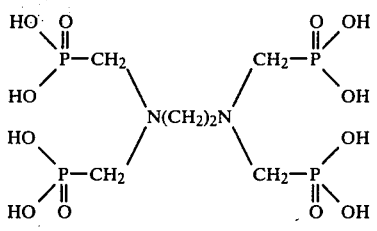

and an outer film of a lubricant retained by said coating.

2. A lubricated cupreous sheet having a surface coating of an organophosphonate compound, said organophosphonate having the structure

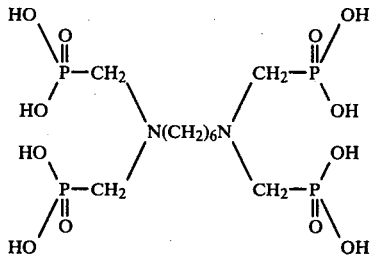

and an outer film of a lubricant retained by said coating.

3. A method of producing a lubricated cupreous sheet, comprising:

(a) providing a cupreous sheet;

(b) applying to said sheet a solution containing an organophosphonic acid and an oxidizing agent for at least 4 seconds, said acid having a structure

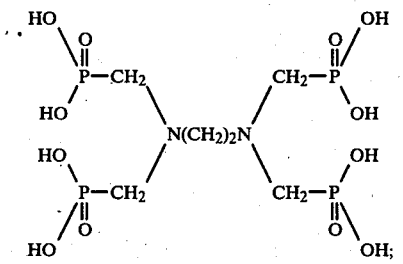

(c) rinsing said sheet;

(d) drying said sheet; and (e) applying a lubricant over the surface of said sheet.

4. A method of producing a lubricated cupreous sheet, comprising:

(a) providing a cupreous sheet;

(b) applying to said sheet a solution containing an organophosphonic acid and an oxidizing agent for at least 4 seconds, said acid having a structure

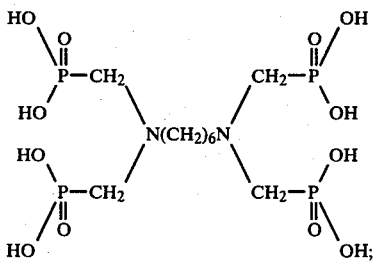

(c) rinsing said sheet;

(d) drying said sheet; and (e) applying a lubricant over the surface of said sheet.

* * * * *